US006746086B1

(12) United States Patent
Foster

(10) Patent No.: US 6,746,086 B1
(45) Date of Patent: Jun. 8, 2004

(54) BENCH WITH MODULAR STRUCTURE

(75) Inventor: Norman Foster, London (GB)

(73) Assignee: Vitra Patente AG (CH)

( * ) Notice: Subject to any disclaimer, the term of this patent is extended or adjusted under 35 U.S.C. 154(b) by 0 days.

(21) Appl. No.: 09/555,004

(22) PCT Filed: Sep. 23, 1998

(86) PCT No.: PCT/IB98/01487

§ 371 (c)(1),
(2), (4) Date: May 22, 2000

(87) PCT Pub. No.: WO00/16661

PCT Pub. Date: Mar. 30, 2000

(51) Int. Cl.[7] ..... A47C 7/00
(52) U.S. Cl. ..... 297/440.14; 297/248; 297/170
(58) Field of Search ..... 297/248, 440.14, 297/232, 170, 440.1

(56) References Cited

U.S. PATENT DOCUMENTS

| | | | | |
|---|---|---|---|---|
| 3,261,640 | A | * | 7/1966 | Straits |
| 3,494,662 | A | * | 2/1970 | Schaefer et al. |
| 5,306,072 | A | * | 4/1994 | Caldwell |

FOREIGN PATENT DOCUMENTS

| | | |
|---|---|---|
| DE | 1554003 | 1/1971 |
| DE | 8620412.2 | 10/1986 |
| EP | 0330594 | 8/1989 |
| EP | 0470036 | 2/1992 |
| GB | 1365422 | 9/1974 |
| GB | 2274391 | 7/1994 |
| GB | 2302504 | 1/1997 |
| NL | 7201186 | 8/1972 |

OTHER PUBLICATIONS

"Vitra®—Classics—Eames Collection" brochure of Vitra GmbH, Weil am Rhein/Germany, 1/86, front page pp. 70–75 and backpage.
"Vitra®—Classics—Eames Collection" brochure of Vitra® GmgH, Weil am Rhein/Germany, 1/86, front page pp. 70 to 75 and backpage.

* cited by examiner

*Primary Examiner*—Milton Nelson, Jr.
(74) *Attorney, Agent, or Firm*—McCarter & English, LLP

(57) ABSTRACT

A bench having a modular structure and comprising several seats, which rest on a longitudinal beam supported on at least two feet. An individual seat is formed by a seat panel which can be complemented by a backrest and lateral armrests, as well as tabletops. Benches of this kind can be used, for example, in airports and ferry terminals as well as long-distance train stations. The seat panels, backrests and tabletops are removably fixed to the longitudinal beam by the use of retaining plates. The feet and armrests are removably fixed directly to the longitudinal beam. The longitudinal beam extends along the full length of the bench, consists preferably of a double-walled aluminum hollow profile and has a regular, triangular cross-section with three longitudinal side faces as well as longitudinal grooves, situated in the area of the edges. The retaining plates are pieces of U-shaped rail sections cut to the required length. A retaining plate connected to a seat panel or a table top rests on the upper, first side face of the longitudinal beam, while retaining plate connected to the backrest contacts the rear surface of the longitudinal beam. The principal advantages of the bench are its variable configurations, the fact that it can be assembled at the place of use and that functional units can be easily replaced. Considerably less transport space is required for the delivery of unassembled functional units.

30 Claims, 6 Drawing Sheets

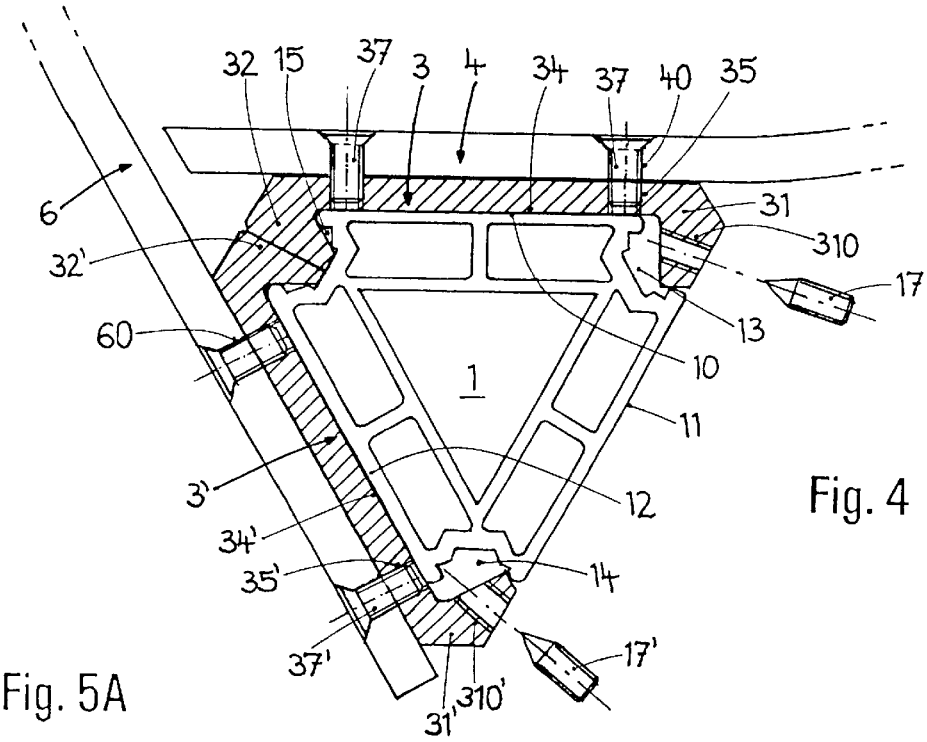
Fig. 4
Fig. 5A
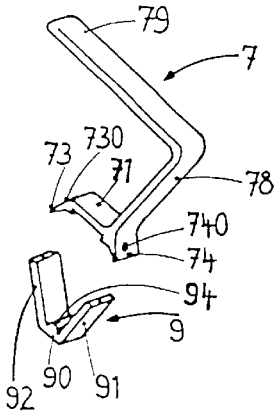
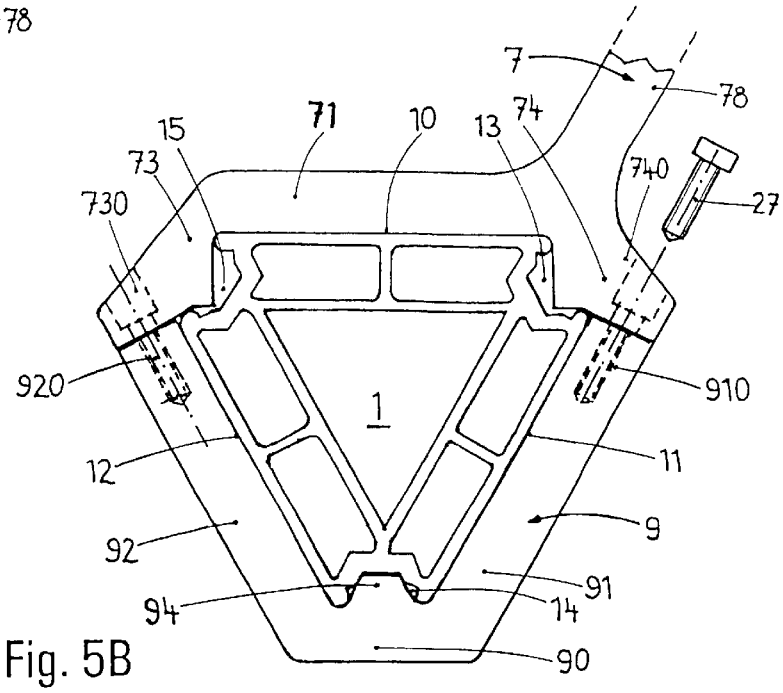
Fig. 5B

BENCH WITH MODULAR STRUCTURE

FIELD OF USE OF THE INVENTION

The invention relates to a bench which can be constructed in a modular manner and has a plurality of seats resting on an underframe. The individual seat has a seat panel which can be supplemented by a backrest and lateral armrests. Tabletops can be fitted on the outside or within the bench. Benches of this type are used, for example, in airports and ferry terminals and also in mainline railroad stations.

PRIOR ART

The "vitra®—CLASSICS—EAMES COLLECTION" brochure of Vitra® GmbH, Weil am Rhein/Germany, 1/86, shows a bench whose underframe consists of a longitudinal beam in the form of a T profile and two feet placed on the ground. The horizontal limb of the T profile lies upward, while the centrally adjoining vertical limb points downward. The feet are screwed onto the outer flanks of the bench or in the vicinity of these outer flanks, grip, with their upwardly open fork, under the T profile and in each case have two extension arms extending transversely to the longitudinal direction of the bench, so that the bench has a secure upright position both in the case of a load tilting forward and in the case of a load tilting backward. In the case of benches having a large number of seat surfaces, further feet are arranged over the length of the bench. On both sides of each seat surface, two approximately L-shaped brackets are in each case screwed from above onto the horizontal limb of the T profile. The seat panel is fitted between the approximately horizontal seat limbs of two adjacent brackets, and the backrest is fitted between the associated, approximately vertical backrest limbs. Screwed onto the backrest limbs are horizontally extending armrests which laterally flank the seat panel in each case situated between them. It is possible for individual seats with their seat panels and backrests to be left free and for tabletops to be fitted there, said tabletops likewise being screwed onto the horizontal limb of the T profile.

These benches have been used for decades. With current requirements for the lowest possible outlay on installation, great variability in the equipment options, space-saving volume while in transportation and saving on weight, the bench described above does no longer fulfill all demands. The brackets used as supports for the seat panels and the backrests, and also the feet are thus relatively bulky and material-intensive. A relatively large number of screw holes have to be made in the feet and the brackets in order to screw them to the longitudinal beam. The result is therefore either a fairly high and time-consuming outlay on installation at the location of use of the benches or the premanufactured benches have to be transported along the delivery route as voluminous pieces of equipment. The brackets are designed for holding seat panels and backrests, so that in the case of benches used in zones for brief stops, the backrests cannot be dispensed with. It would likewise be problematical to leave out the armrests, which are always provided, for brief stops.

OBJECT OF THE INVENTION

In view of the imperfections described above, the invention is based on the object of proposing a bench of this type which can be constructed in a modular manner and has a longitudinal beam in the underframe, and whose functional units, namely the seat panels, backrests, armrests and tabletops, can be arranged in a freely variable manner without having to follow a grid of clamping elements provided in a fixed manner. The intention is to enable the bench to be constructed on the basis of releasable connections, so that the installation at the location of use can be undertaken in a time-saving and efficient manner. All of the abovementioned functional elements, and also the feet and supports, are to take up as little space as possible during storage and transportation. The subsequent modification and the maintaining of constructed benches must be simple to implement. Obviously, the bench has to ensure a secure upright position even when loaded unevenly. Finally, the intention is to be able to produce the bench in an efficient manner, at favorable costs, while also satisfying individual customer's wishes. In the long run, the construction has to permit a design corresponding to contemporary tastes.

SUMMARY OF THE INVENTION

The essence of the invention resides in the bench which can be constructed in a modular manner having a longitudinal beam resting on feet as the underframe, the individual seat panel and the individual backrest, and also tabletops which can optionally be inserted individually, being connected to one retaining plate in each case, and all of the retaining plates being fixed to the longitudinal beam. The connection between the seat panel, backrest or tabletop, on the one hand, and the retaining plate, on the other hand, is preferably releasable and realized, for example, by means of screws. The fixing of the retaining plates to the longitudinal beam is likewise configured to be releasable, preferably by means of screws. The feet supporting the longitudinal beam, and also armrests which can optionally be inserted, are releasably mounted directly onto the longitudinal beam. The longitudinal beam extends over the entire length of the bench and preferably has a uniform, triangular cross section with three longitudinal side surfaces and three longitudinal grooves in the corner regions. In a preferred embodiment, the longitudinal beam is a double-walled aluminum hollow profile.

The retaining plates used are pieces of rail resembling a U profile which are cut off to the required length and have a central flat section and short side sections. In the fitted state, the flat section of a retaining plate which is connected to a seat panel or a tabletop rests on the upper side surface of the longitudinal beam. The armrests are mounted, likewise resting on the upper side surface of the longitudinal beam. The flat section of a retaining plate which is connected to a backrest rests on the side surface of the longitudinal beam which is at the rear with respect to the bench.

The two separate legs together forming a foot are mounted in pairs onto the longitudinal beam, one leg joining onto the front side surface and the other leg joining onto the rear side surface. The legs are either connected to an armrest arranged above them or, for countersupport purposes, to a bridge part, the three parts clasping the longitudinal beam. If there is no foot for countersupport purposes at the position in which an armrest is used, a bracket part clasping the longitudinal beam from below is used. The legs are releasably connected, for example screwed, to the armrest or to the bridge part and the armrest to the bracket part.

The bench according to the invention allows a variable configuration thereof with armrests and tabletops which can be fitted next to the seat panels and backrests, without having to be tied down to a grid consisting of fixed clamping elements or weld points. The cutting of the longitudinal beam to the required length from a profiled rod, the entire installation and modification of the bench and also the interchange of functional units for maintenance purposes at the location of use can take place directly and efficiently. The design phases therefore are simplified. During the delivery and storage of the unassembled functional units of a bench, decidedly less space is required than for a bench which has already been assembled. The saving on space multiplies if a relatively large area, for example an airport terminal, is to be equipped with a large number of benches.

BRIEF DESCRIPTION OF THE ATTACHED DRAWINGS

In the drawings:

FIG. 4 shows the fastening of the seat panel and backrest as a partial section;

FIG. 5A shows an armrest with a bracket part;

FIG. 5B shows the fastening of the armrest with a bracket part in a front view;

EXEMPLARY EMBODIMENT

Figure 1:
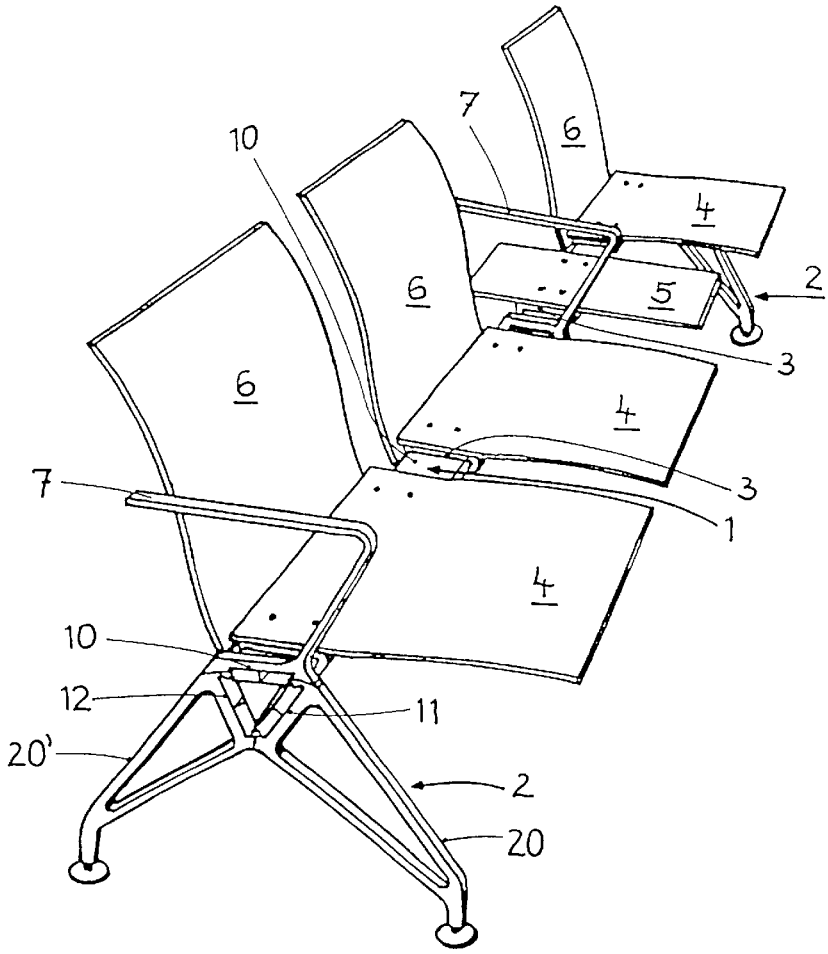
FIG. 1 shows a bench as a whole in a perspective representation.

The detailed description of an exemplary embodiment of the bench according to the invention is given below with reference to the attached drawings. Possible modifications which are worth mentioning are listed in the annex to the description.

The following statement applies to the entire further description: if reference numbers are contained in a figure for the purpose of diagrammatical unambiguousness, that are not explained in the directly appended text of the description, reference is made to where they are mentioned in the preceding or subsequent description of the figures. In the interests of clarity, repeated designation of components in subsequent figures is generally dispensed with, as long as it can unambiguously be recognized diagrammatically that these are "recurring" components.

FIG. 1

As the underframe, the bench has a longitudinal beam 1 which extends horizontally and over the entire length of the bench onto which longitudinal beam at least two feet 2 are joined. The longitudinal beam 1 has a cross-sectional profile which is in principle triangular and has three longitudinally running, identical side surfaces 10,11,12, the first side surface 10 lying horizontally on the top, the second, oblique side surface 11 being directed forward, and the third, likewise oblique side surface 12 lying at the rear of the bench. Profiled retaining plates 3, to which seat panels 4 or tabletops 5 are fastened, are placed onto and fixed to the upper side surface 10. In this example, two seat panels 4 have been arranged next to each other, followed by a tabletop 5 and then a further seat panel 4. Retaining plates 3' are also used in order to fasten the backrests 6 which are assigned to the seat panels 4, the retaining plates 3' then being fixed to the third, rear side surface 12 (see FIGS. 2 and 4). A foot 2 consists of two identical, separate legs 20,20' which, facing each other in a plane, are joined to the longitudinal beam 1 at the second and third side surfaces 11,12. Armrests 7, which are placed on the first side surface 10, lying at the top, of the longitudinal beam 1, can be attached to the side of each seat panel 4. In the example shown, only the double group of seats having the seat panels 4 and the backrests 6 has a respective armrest 7 on the external side. Therefore, only the user sitting in the front seat would be able to be supported with his right arm, while the middle user has a support for his left arm.

Figure 3A:
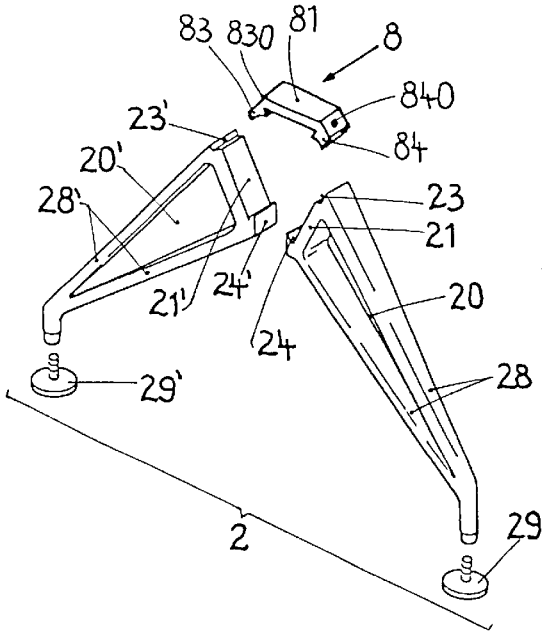
FIG. 3A shows a foot having two legs and a bridge part.
Figure 2:
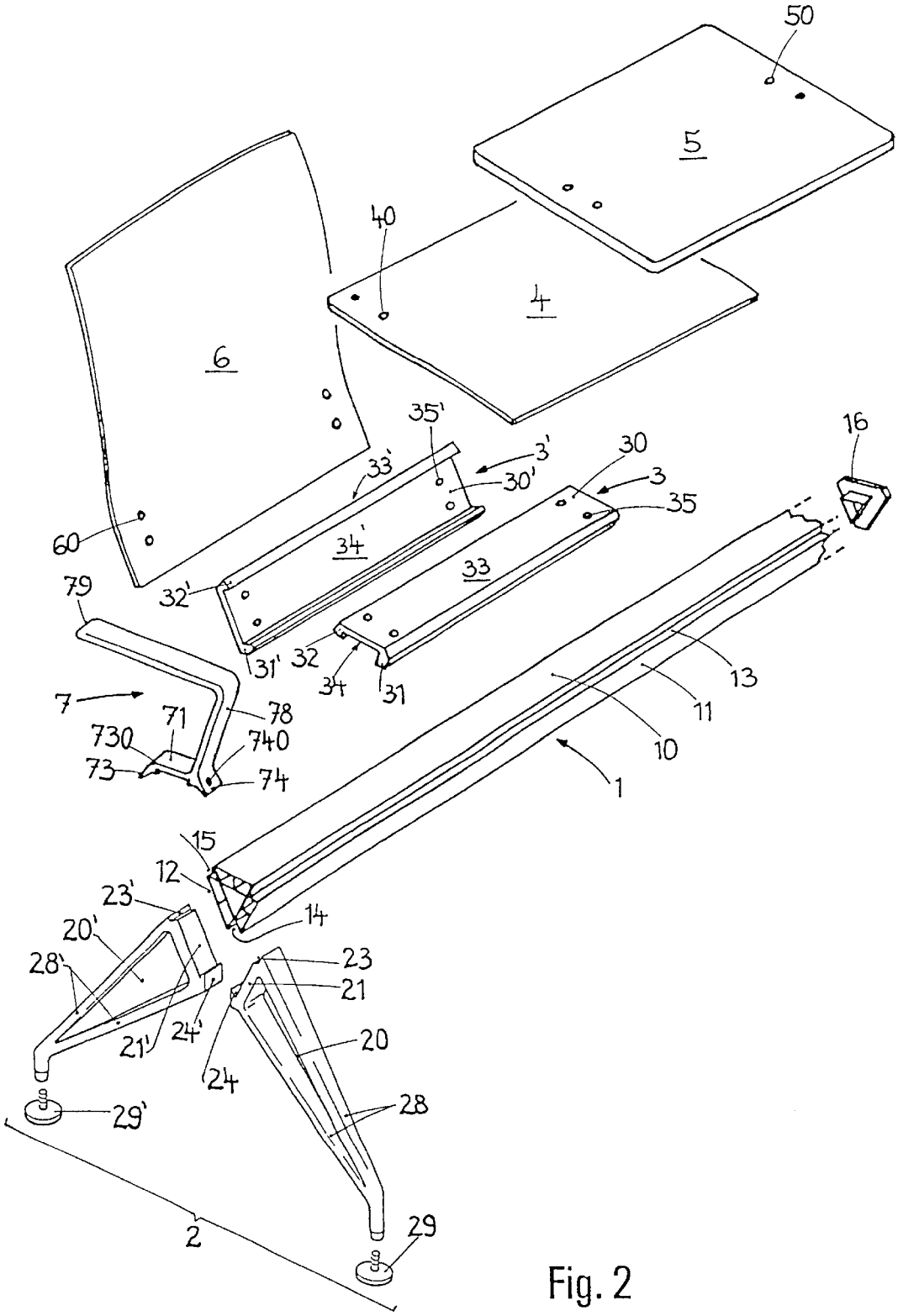
FIG. 2 shows the component parts of the bench in an exploded representation.

FIGS. 2 and 3A

The longitudinal beam 1 has the three outer side surfaces 10,11,12 and a respective, axially extending, first, second and third longitudinal groove 13,14,15 in the three edge regions of the cross-sectionally triangular longitudinal beam 1, which is preferably a double-walled aluminum hollow profile. The top, first side surface 10 is therefore flanked by the first and the third longitudinal grooves 13,15, the front, second side surface 11 lies between the first and the second longitudinal grooves 13,14, while the rear, third side surface 12 is situated between the second and the third longitudinal grooves 14,15. All of the side surfaces 10,11,12 and all of the longitudinal grooves 13,14,15 are identical.

The individual front and rear legs 20,20' of a foot 2 each have a base strut 21,21' and longitudinal struts 28,28' which are joined thereto, extend toward the ground and open into a foot element 29,29' placed onto the ground. This foot element 29,29' can be adjusted in height and is therefore suitable for leveling off the bench. The base strut 21 of the front, first leg 20 is intended for joining to the front, second side surface 11, and the base strut 21' of the rear, second leg 20' is intended for joining to the rear, third side surface 12. The base strut 21,21' has a recess 23,23' on the upper edge and an upwardly pointing hook contour 24,24' on the lower edge. The retaining plate 3,3' is a cut-off piece of rail having the central flat section 30,30' of the chamfer 31,31' joining the latter on one side, and also the claw section 32,32' joining the flat section 30,30' opposite the chamfer 31,31'. On the flat section 30,30', the upper surface 33,33' thereof and the lower surface 34,34' thereof are defined. The chamfer 31,31' and the claw section 32,32' are situated on the lower surface 34,34', the claw section 32,32' extending therefrom at an angle of approximately 90° with the lower surface 34,34', while the chamfer 31,31' extends therefrom approximately at right angles to the lower surface 34,34'. In the flat section 30,30' there are pairs of holes 35,35' serving for the passage of fastening elements for fastening seat panels 4, tabletops 5 or backrests 6 to the retaining plate 3,3'. One such hole 35,35' is designed, for example, as a through-hole for inserting a screw through from the lower surface 34,34' of the retaining plate 3,3', the screw shaft then engaging in the seat panel 4, tabletop 5 or backrest 6 which is to be supported. If the hole 35,35' is provided as an internally threaded hole, the screw head is situated on the side of the seat panel 4, tabletop 5 or backrest 6. When the retaining plate 3 is used to fasten a seat panel 4 or tabletop 5, the lower surface 34 of the flat section 30 of the retaining plate 3 comes to lie on the upper, first side surface 10 of the longitudinal beam 1; if the retaining plate 3' is used to fasten a backrest 6, the lower surface 34' bears against the rear, third side surface 12 (see FIG. 4).

The ergonomically curved seat panel 4 is an at least largely rigid surface structure—for example a wooden or plastic panel, which can be covered with visually decorative and skin-friendly material, such as leather or fabric. In the rear region of the seat panel 4 are holes 40 which are arranged in a complementary manner with respect to the holes 35 in the retaining plate 3 in order to introduce fastening elements.

A surface structure is likewise used for the tabletop 5, for example again a wooden or plastic panel. A retaining plate 3 having the holes 35 provided in it for holding fastening elements is also used for the fastening of the tabletop 5. It is appropriate to arrange the holes 50 to be provided in the tabletop 5 in a complementary manner with respect to the holes 35 in the retaining plate 3 not in the rear region of said tabletop, but rather closer to the central axis. A tabletop 5 having a relatively large surface can therefore be used which nevertheless does not protrude forward over the front edges of the seat panels 4, but rather extends partially rearward with respect to the bench.

The backrest 6 also has an ergonomic curvature and, as an at least largely rigid surface structure, can be a wooden or plastic panel which has a cover identical to or similar to the seat panel 4. The holes 60 for introducing fastening elements—again in a complementary manner with respect to the holes 35' in the retaining plate 3' used—are positioned in the lower region of the backrest 6.

Right at the bottom, the armrest 7, which is provided for arranging to the side of a seat panel 4 and for placing onto the upper, first side surface 10 of the longitudinal beam 1, has a transverse strut 71, a branch 78 rising obliquely forward from the latter and also a bracket 79 which is bent horizontally rearward from the branch 78 and ends freely. The transverse strut 71 is intended for placing onto the side surface 10. A downwardly bent toe 73 joins the rear of the transverse strut 71, rearward with respect to the bench. A downwardly bent shoulder 74 extends at the front of the transverse strut 71, below the rising branch 78. The toe 73 and shoulder 74 are in principle of identical shape and a hole 730,740 for the passage of fastening elements runs through both of them.

A covering plate 16 which is congruent to the cross section of the longitudinal beam 1 and which can be plugged onto the two open ends of the longitudinal beam 1 is provided for the lateral closure of the hollow longitudinal beam 1.

If no armrest 7 is mounted above a foot 2 joined with its two legs 20,20' to the longitudinal beam 1, the missing transverse strut 71 of the armrest 7 is replaced by a clamp-shaped bridge part 8 which, for its part, has a transverse bridge strut 81, a bridge toe 83 and a bridge shoulder 84. The bridge toe 83 and bridge shoulder 84 have the same configuration and a bridge hole 830,840 for the passage of fastening elements runs through both of them.

Figure 3B:
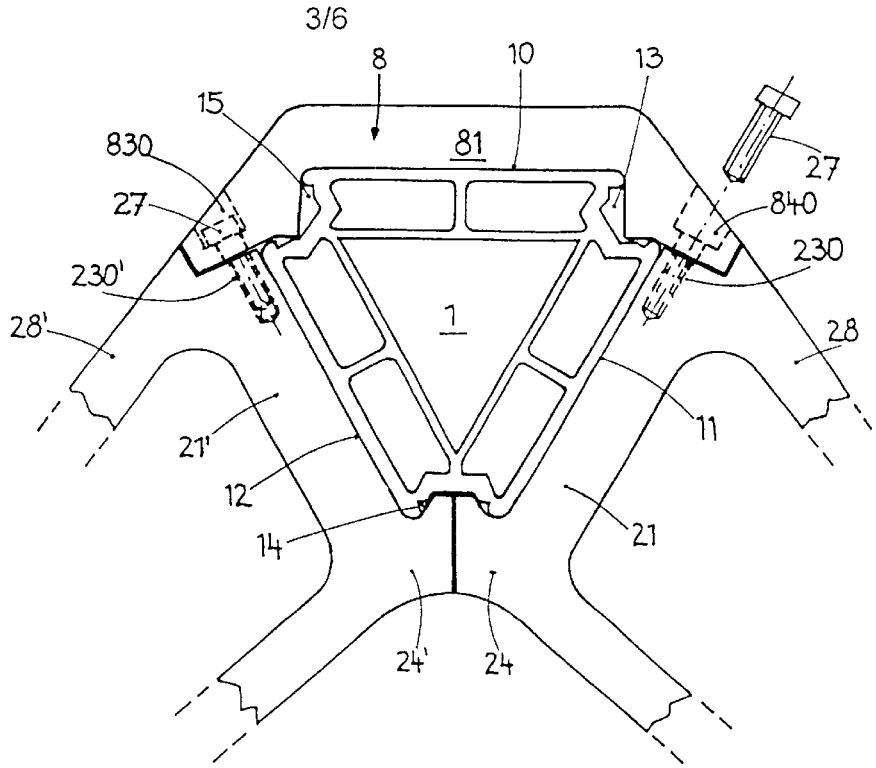
FIG. 3B shows the end fastening of a foot in a front view.
Figure 3C:
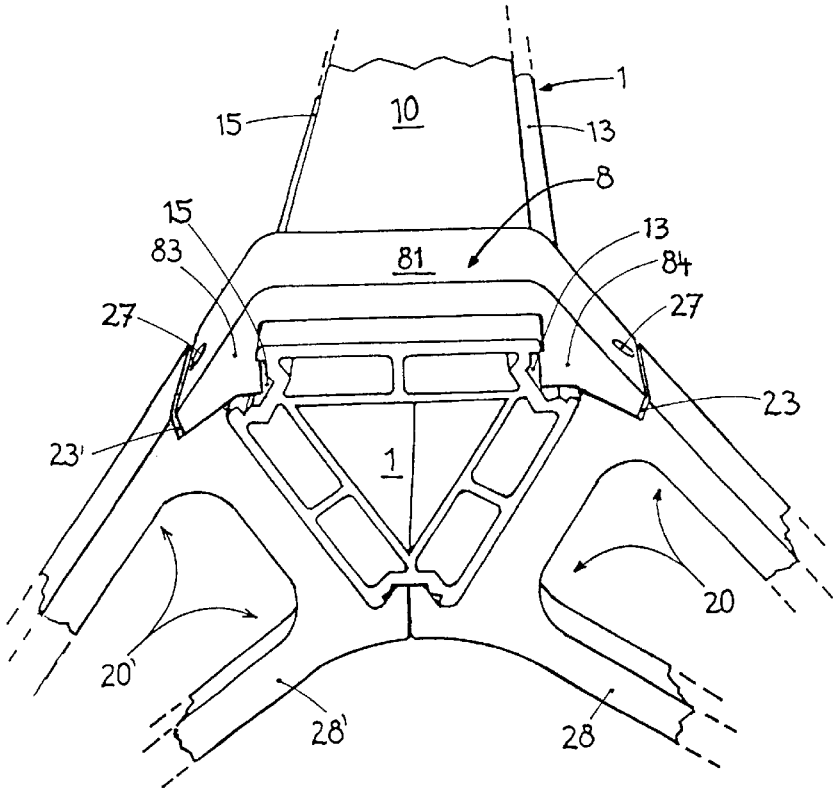
FIG. 3C shows the representation according to FIG. 3B in perspective.

FIGS. 3B and 3C

Around the longitudinal beam 1, the two legs 20,20' are joined laterally and the bridge part 8 is joined on top. In this case, the base struts 21,21' bear against the front, second side surface 11 and, respectively, against the rear, third side surface 12. The two hook contours 24,24' each engage in the lower, second longitudinal groove 14 and abut flush against each other. The recesses 23,23' on the legs 20,20' come to lie adjacent to the first and third longitudinal grooves 13,15 respectively. From the recess 23,23' an internal threaded hole 230,230' extends into the base strut 21,21'. The transverse strut 81 of the bridge part 8 rests on the upper, first side surface 10 of the longitudinal beam 1. The toe 83 and shoulder 84 of the bridge part 8 protrude partially into the third and first longitudinal grooves 15,13 respectively, on the longitudinal beam 1 and at the same time come to lie in the recesses 23',23 of the legs 20',20. The holes 830,840 in the bridge part 8 are aligned with the internal threaded holes 230',230 in the base struts 21',21, so that screws 27 can be screwed as fastening elements through the bridge part 8 into the legs 20,20'. This produces around the longitudinal beam 1 a braced interconnection consisting of the two legs 20,20', extending toward the ground, and of the bridge part 8 resting on top.

FIG. 4

The fastening of the horizontal seat panel 4 and backrest 6 to the longitudinal beam 1 by means of a respective retaining plate 3,3' can be seen. Through the holes 40 in the seat panel 4, screws 37 engage in the holes 35, which are designed as internal threaded holes, in the retaining plate 3 whose lower side 34 rests on the first side surface 10. The claw section 32 of the retaining plate 3 fits around the side surface 10 and engages in the third longitudinal groove 15 on the longitudinal beam 1. Provided in the chamfer 31 of the retaining plate 3, which chamfer fits over the first longitudinal groove 13 in the transverse direction, is an internal threaded hole 310 which is directed toward this first longitudinal groove 13. A clamping screw 17 can be screwed into the internal threaded hole 310 and the top of said screw presses in the first longitudinal groove 13 against the longitudinal beam 1 and thus fixes the retaining plate 3 together with the screwed-on seat panel 4.

The screw connection between the backrest 6 and retaining plate 3' and also the fixing of the backrest 6 to the longitudinal beam 1 are realized in the same manner. Through the holes 60 in the backrest 6, screws 37' engage in the internal threaded holes 35' of the retaining plate 3' whose lower side 34' rests on the third side surface 12 of the longitudinal beam 1. The claw section 32' of this retaining plate 3' fits around the third side surface 12, engages in the third longitudinal groove 15 on the longitudinal beam 1 and coincides here with the claw section 32 of the retaining plate 3, which is screwed to the seat panel 4. Also provided in the chamfer 31' of the retaining plate 3', which fits over the second longitudinal groove 14 in the transverse direction, is an internal threaded hole 310' which is directed toward this second longitudinal groove 14. A clamping screw 17' is likewise screwed into the internal threaded hole 310' and the tip of said screw presses in the second longitudinal groove 14 against the longitudinal beam 1 and thus fixes the retaining plate 3' together with the screwed-on backrest 6. If the tip of the clamping screw 17,17' in the longitudinal grooves 13,14 butts against the longitudinal beam 1, with further screwing in of the clamping screw 17,17' the claw section 32,32' of the retaining plate 3,3' is pulled more securely into the third longitudinal groove 15.

Figure 5C:
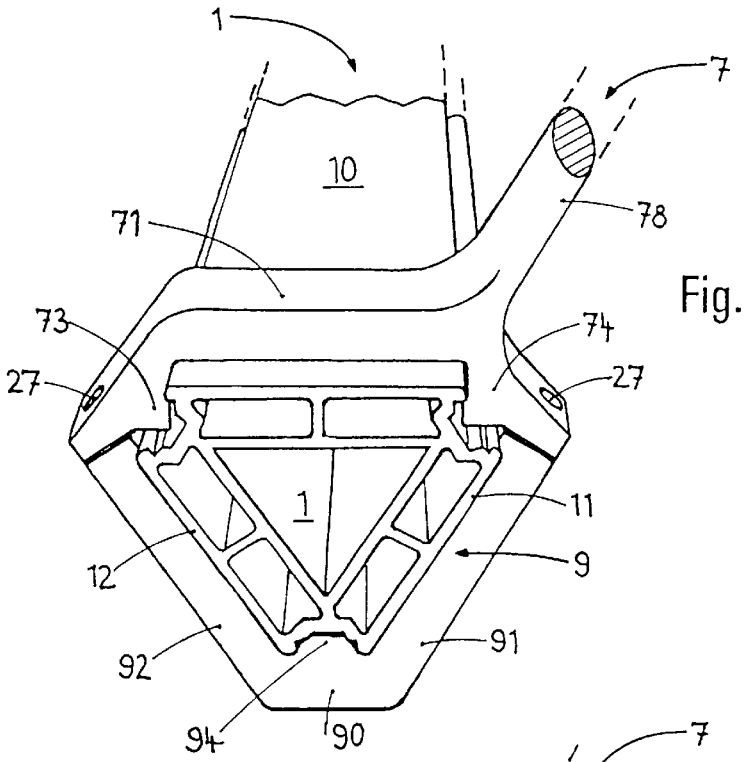
FIG. 5C shows the representation according to FIG. 5B in perspective.

FIGS. 5A to 5C

If the armrest 7 is placed onto the longitudinal beam 1 at a position at which there is no foot 2 with its two legs 20,20' below it, the legs 20,20', which for countersupport purposes are missing, together with their base struts 21,21' are replaced by a V-shaped bracket part 9. A short bottom strut 90 and also a respective flank strut 91,92 rising laterally therefrom form the single-piece bracket part 9. If the bracket part 9 is plugged onto the longitudinal beam 1 from the side of the second longitudinal groove 14, the two flank struts 91,92 are joined to the second and third side surfaces 11,12 of the longitudinal beam 1, while the bottom strut 90 covers the second longitudinal groove 14 of the longitudinal beam 1. A lug 94 can be present in the center of the upper side of the bottom strut 90, the lug corresponding in its configuration to the two joined-together hook contours 24,24' on the legs 20,20' and being intended for the engagement in the lower, second longitudinal groove 14 on the longitudinal beam 1. The flank struts 91,92 end level with the first and third longitudinal grooves 13,15. A respective internal threaded hole 910,920 extends from the free ends of the flank struts 91,92, for the screwing to the armrest 7 which is to be placed onto the first side surface 10 of the longitudinal beam 1 above the bracket part 9.

The transverse strut 71 of the armrest 7 rests on the first side surface 10. Holes 730,740 are provided in the toe 73 and shoulder 74, which holes are aligned with the internal threaded holes 920,910 in the bracket part 9, so that screws 27 can be screwed in. The outer regions of the lower sides of the toe 73 and shoulder 74 rest on the free ends of the flank struts 92,91, while the rear regions partially protrude into the third and first longitudinal grooves 15,13, respectively. In order to attach an armrest 7, either a foot 2 with its two legs 20,20' or a bracket part 9 is required as the counterpart. Each seat panel 4, irrespective of its position, can therefore be assigned armrests 7, as required.

Figure 6A:
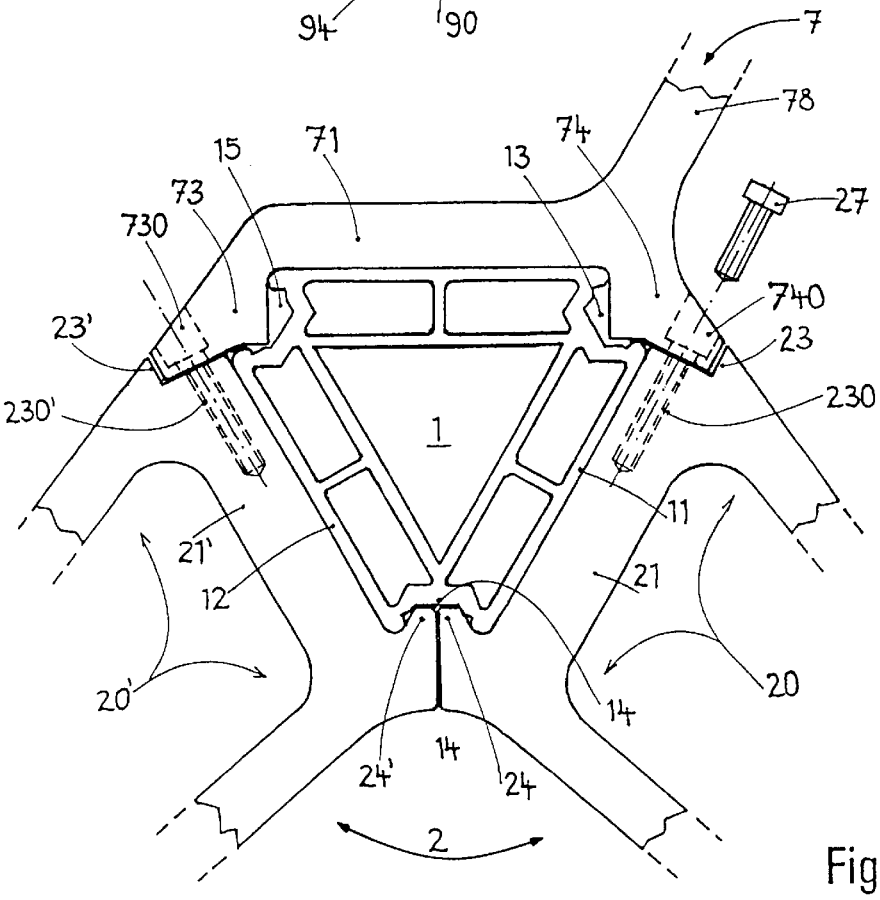
FIG. 6A shows the fastening of the armrest and to a foot arranged below it, in a front view.
Figure 6B:
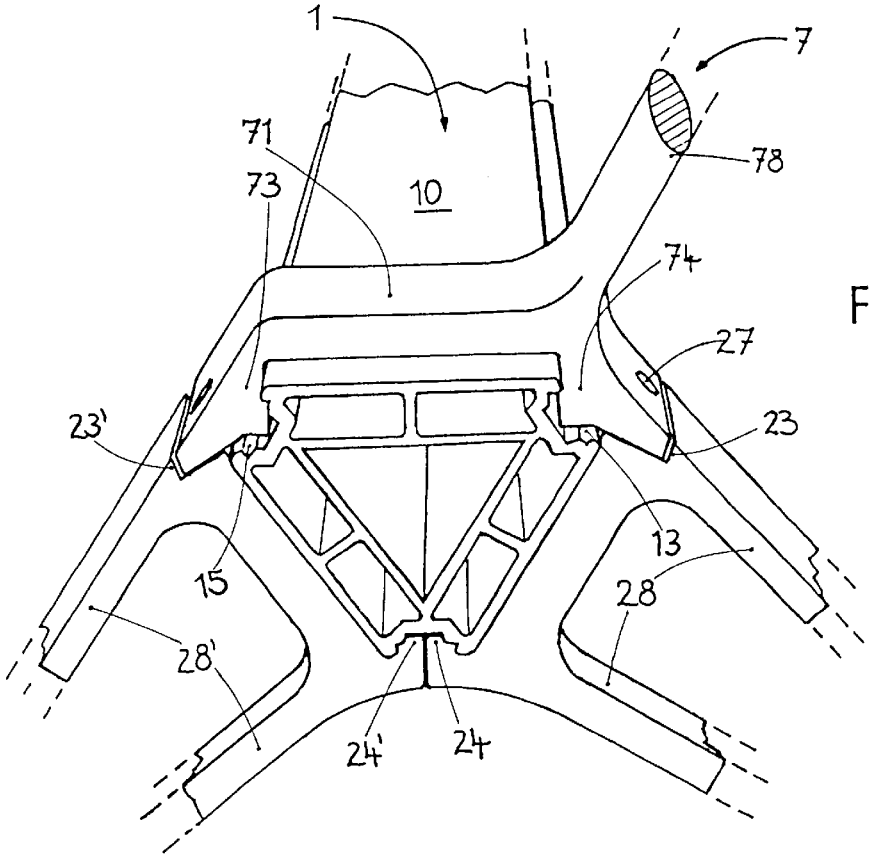
FIG. 6B shows the representation according to FIG. 6A in perspective.
Figure 7:
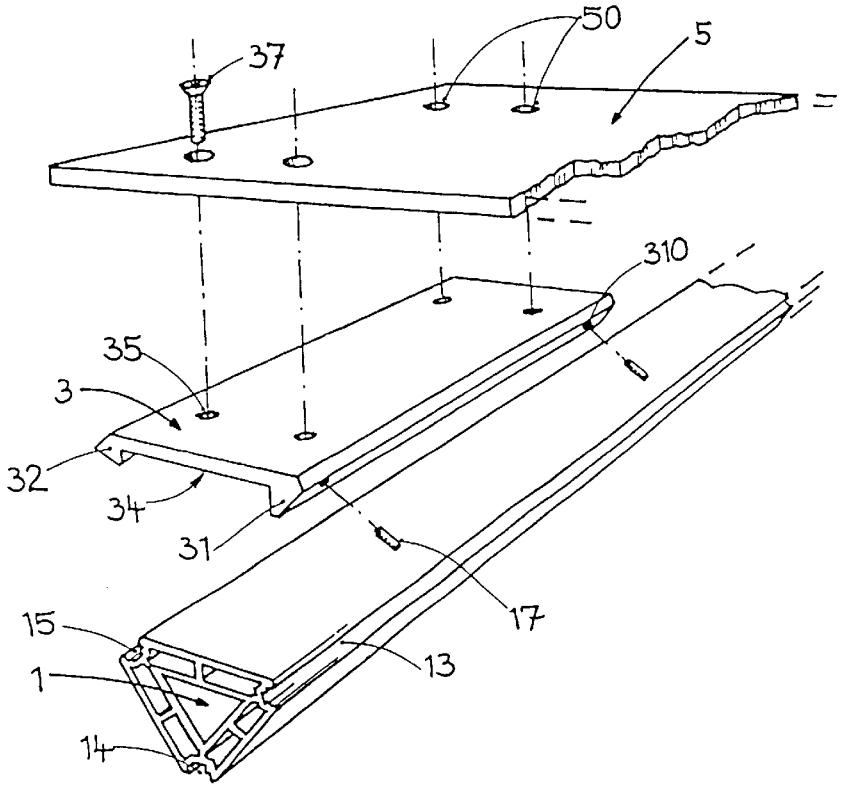
FIG. 7 shows the fastening of a tabletop.

FIGS. 6A and 6B

This arrangement could occur at the end or within a relatively long bench, where a foot 2 for supporting, and an armrest 7 above it, are provided at the same time. Instead of having a bracket part 9, the armrest 7, which is placed onto the longitudinal beam 1, is now screwed to a foot 2 arranged below it and consisting of two identical legs 20,20'. The configuration and positioning of the foot 2 at the bottom of the longitudinal beam 1 and of the armrest 7 on the longitudinal beam 1 correspond to FIGS. 3B and 3C and 5B and 5C, respectively. The base struts 21,21' of the legs 20,20' bear against the second and third side surfaces 11,12 of the longitudinal beam 1. The recesses 23,23' of the legs 20,20' lie adjacent to the first and third longitudinal grooves 13,15, and the hook contours 24,24' lying together engage in the lower, second longitudinal groove 14. The outer regions of the lower sides of the toe 73 and shoulder 74 are fitted into the recesses 23',23, while the rear regions partially protrude into the third and first longitudinal grooves 15,13, respectively. The internal threaded holes 230,230' in the legs 20,20' receive the screws 27 introduced through the holes 740,730 in the armrest 7.

FIG. 7

For the fastening of the tabletop 5, use is likewise made of a retaining plate 3, as for the fastening of a seat panel 4. The configuration and positioning of the retaining plate 3 on the longitudinal beam 1 correspond to FIGS. 2 and 4. The retaining plate 3 is placed with its lower side 34 onto the upper, first side surface 10 of the longitudinal beam 1. Through the holes 50 in the tabletop 5, screws 37 engage in the internal threaded holes 35 in the retaining plate 3, so that the tabletop 5 is screwed firmly onto the retaining plate 3. When placed on, the claw section 32 of the retaining plate 3 engages in the third longitudinal groove 15, while the chamfer 31 fits transversely over the first longitudinal groove 13. Again, at least one internal threaded hole 310 which is directed toward the first longitudinal groove 13 is provided in the chamfer 31 in order to receive a clamping screw 17. If the interconnection of the retaining plate 3 and tabletop 5 is to be fixed in its axial position on the longitudinal beam 1, this happens by screwing in the clamping screw 17, so that its tip presses against the longitudinal beam 1 in the first longitudinal groove 13.

In addition to the embodiments described above of the bench, further structural variations can be realized. Express mention should further be made here of the following:

Obviously, the length of the bench can be selected as desired depending on the space available and arrangement of an area of benches, and the fitting with seat panels 4, tabletops 5, backrests 6 and armrests 7 can take place in a variable manner. In waiting zones having relatively short waiting times, the back and armrests 6,7 and also the tabletops 5 could be dispensed with, while in waiting zones having periods of stay lasting several hours—for example transit areas in intercontinental airports or on passenger ferries with a crossing lasting several hours—the bench is provided with comfortable fittings.

The bench can be supplemented by tabletops 5 which are fixed to the ends of the longitudinal beam 1. The fastening could take place by the supplementing tabletops 5 having protruding supporting shafts which plug laterally into the longitudinal beam 1. Profiled sections 3 for fastening these tabletops 5 are not required.

In principle, the partial engagement of the toe 83 and the shoulder 84 of the bridge part 8 in the third and first longitudinal grooves 15,13 on the longitudinal beam 1 can be omitted. By means of the engagement, increased strength of the connection is achieved over and beyond the screw connection.

Instead of the hook contours 24,24' of the legs 20,20', which hook contours engage in the lower, second longitudinal groove 14 on the longitudinal beam 1, a screw connection or another releasable or fixed connection could be provided at the top between the two legs 20,20'.

Given sufficient structural adaptation of the upper part of the legs 20,20', of the retaining plate 3 in the region of the claw section 32, of the armrest 7, of the bridge part 8 and of the bracket part 9, the longitudinal beam could be fitted with four side surfaces and four longitudinal grooves.

Benches set up in a row or rearward with respect to one another can be connected to one another by strutting, so that securing to the ground is unnecessary and also shorter benches can, in principle, not be shifted by the public, thereby avoiding a disorderly appearance in the waiting area.

It is possible also to fasten more than one seat panel 4, tabletop 5 or backrest 6 on a relatively long retaining plate 3,3', and to fix this assembly to the longitudinal beam 1.

What is claimed is:

1. A bench constructed in a modular manner, comprising:

an underframe having a longitudinal beam that is supported by at least two feet, each of said at least two feet being releasably fixed directly to said longitudinal beam;

at least one seat panel and at least one first retaining plate, each of said at least one seat panel being attached to a corresponding one of said at least one first retaining plate, and each of said at least one first retaining plate being releasably fixed directly to said longitudinal beam; and at least one backrest and at least one second retaining plate, each of said at least one backrest being attached to a corresponding one of said at least one second retaining plate, and each of said at least one second retaining plate being releasably fixed directly to said longitudinal beam, wherein each of said at least one seat panel is fastened to said corresponding one of said at least one first retaining plate by means of a first plurality of screws, and each of said at least one backrest is fastened to said corresponding one of said at least one second retaining plate by means of a second plurality of screws, wherein each of said at least one seat panel has a first plurality of holes therethrough, each of said first plurality of holes receiving a corresponding one of said first plurality of screws, and each of said first plurality of screws engaging a corresponding one of a first plurality of internally threaded holes in said corresponding one of said at least one first retaining plate, and wherein each of said at least one backrest has a second plurality of holes therethrough, each of said second plurality of holes receiving a corresponding one of said second plurality of screws, and each of said second plurality of screws engaging a corresponding one of a second plurality of internally threaded holes in said corresponding one of said at least one second retaining plate.

2. A bench constructed in a modular manner, comprising:

an underframe having a longitudinal beam that is supported by at least two feet, each of said at least two feet being releasably fixed directly to said longitudinal beam, said bench having one end and an opposite end, said longitudinal beam extending from said one end to said opposite end of said bench, said longitudinal beam having a uniform, triangular cross section formed by three longitudinal side surfaces, including a top surface, a front surface and a rear surface, at least one seat panel and at least one first retaining plate, each of said at least one seat panel being attached to a corresponding one of said at least one first retaining plate, and each of said at least one first retaining plate being releasably fixed directly to said longitudinal beam; and at least one backrest and at least one second retaining plate, each of said at least one backrest being attached to a corresponding one of said at least one second retaining plate, and each of said at least one second retaining plate being releasably fixed directly to said longitudinal beam.

3. The bench as claimed in claim 2, wherein each of said at least one first retaining plate is a first rail piece with a U-shaped profile, said first rail piece having a central flat section with an upper surface and a lower surface, a chamfer that is provided on one side of said lower surface of said flat section of said first rail piece, and a claw section that is provided on an opposite side of said lower surface of said flat section of said first rail piece, said flat section of said first rail piece being placed onto said top surface of said longitudinal beam; and each of said at least one second retaining plate is a second rail piece with a U-shaped profile, said second rail piece having a central flat section with an upper surface and a lower surface, a chamfer that is provided on one side of said lower surface of said flat section of said second rail piece, and a claw section that is provided on an opposite side of said lower surface of said flat section of said second rail piece, said flat section of said second rail piece being joined onto said rear surface of said longitudinal beam.

4. The bench as claimed in claim 3, wherein said longitudinal beam has three longitudinal grooves, including a first longitudinal groove, a second longitudinal groove and a third longitudinal groove, said first longitudinal groove being located in a corner region formed between said top surface and said front surface of said longitudinal beam, said second longitudinal groove being located in a corner region formed between said front surface and rear surface of said longitudinal beam, and said third longitudinal groove being located in a corner region formed between said top surface and said rear surface of said longitudinal beam;

said claw section of said first rail piece engages in said third longitudinal groove and said chamfer of said first rail piece at least partially fits over said first longitudinal groove; and said claw section of said second rail piece engages in said third longitudinal groove and said chamfer of said second rail piece at least partially fits over said second longitudinal groove.

5. The bench as claimed in claim 4, wherein said chamfer of said first rail piece includes an internally threaded hole to receive a first clamping screw having an end tip, said internally threaded hole of said chamfer of said first rail piece being oriented such that when said first clamping screw is screwed into said internally threaded hole of said chamfer of said first rail piece, said end tip of said first clamping screw enters said first longitudinal groove and presses against said longitudinal beam thereby fixing said first rail piece and said at least one seat panel on said longitudinal beam at a selected position; and said chamfer of said second rail piece includes an internally threaded hole to receive a second clamping screw having an end tip, said internally threaded hole of said chamfer of said second rail piece being oriented such that when said second clamping screw is screwed into said internally threaded hole of said chamfer of said second rail piece, said end tip of said second clamping screw enters said second longitudinal groove and presses against said longitudinal beam thereby fixing said second rail piece and said at least one backrest on said longitudinal beam at a selected position.

6. The bench as claimed in claim 2, wherein each of said at least one seat panel is releasably fastened on said corresponding one of said at least one first retaining plate, and each of said at least one backrest is releasably fastened on said corresponding one of said at least one second retaining plate.

7. The bench as claimed in claim 2, wherein each of said at least one seat panel is fastened to said corresponding one of said at least one first retaining plate by means of a first plurality of screws, and each of said at least one backrest is fastened to said corresponding one of said at least one second retaining plate by means of a second plurality of screws.

8. The bench as claimed in claim 2, wherein said longitudinal beam has a uniform, triangular cross section with a double-walled aluminum hollow profile.

9. The bench as claimed in claim 2, further comprising at least one tabletop and at least one third retaining plate, wherein each of said at least one tabletop is attached to a corresponding one of said at least one third retaining plate, each of said at least one third retaining plate being releasably fixed directly to said longitudinal beam; and wherein each of said at least one first retaining plate is a first rail piece with a U-shaped profile, said first rail piece having a central flat section with an upper surface and a lower surface, a chamfer that is provided on one side of said lower surface of said flat section of said first rail piece, and a claw section that is provided on an opposite side of said lower surface of said flat section of said first rail piece, said flat section of said first rail piece being placed onto said top surface of said longitudinal beam, and each of said at least one second retaining plate is a second rail piece with a U-shaped profile, said second rail piece having a central flat section with an upper surface and a lower surface, a chamfer that is provided on one side of said lower surface of said flat section of said second rail piece, and a claw section that is provided on an opposite side of said lower surface of said flat section of said second rail piece, said flat section of said second rail piece being joined onto said rear surface of said longitudinal beam, and each of said at least one third retaining plate is a third rail piece with a U-shaped profile, said third rail piece having a central flat section with an upper surface and a lower surface, a chamfer that is provided on one side of said lower surface of said flat section of said third rail piece, and a claw section that is provided on an opposite side of said lower surface of said flat section of said third rail piece, said flat section of said third rail piece being placed onto said top surface of said longitudinal beam.

10. The bench as claimed in claim 9, wherein said longitudinal beam has three longitudinal grooves, including a first longitudinal groove, a second longitudinal groove and a third longitudinal groove, said first longitudinal groove being located in a corner region formed between said top surface and said front surface of said longitudinal beam, said second longitudinal groove being located in a corner region formed between said front surface and rear surface of said longitudinal beam, and said third longitudinal groove being located in a corner region formed between said top surface and said rear surface of said longitudinal beam;

said claw section of said first rail piece engages in said third longitudinal groove and said chamfer of said first rail piece at least partially fits over said first longitudinal groove;

said claw section of said third rail piece engages in said third longitudinal groove and said chamfer of said third rail piece at least partially fits over said first longitudinal groove; and said claw section of said second rail piece engages in said third longitudinal groove and said chamfer of said second rail piece at least partially fits over said second longitudinal groove.

11. The bench as claimed in claim 10, wherein said chamfer of said first rail piece includes an internally threaded hole to receive a first clamping screw having an end tip, said internally threaded hole of said chamfer of said first rail piece being oriented such that when said first clamping screw is screwed into said internally threaded hole of said chamfer of said first rail piece, said end tip of said first clamping screw enters said first longitudinal groove and presses against said longitudinal beam thereby fixing said first rail piece and said at least one seat panel on said longitudinal beam at a selected position; and said chamfer of said second rail piece includes an internally threaded hole to receive a second clamping screw having an end tip, said internally threaded hole of said chamfer of said second rail piece being oriented such that when said second clamping screw is screwed into said internally threaded hole of said chamfer of said second rail piece, said end tip of said second clamping screw enters said second longitudinal groove and presses against said longitudinal beam thereby fixing said second rail piece and said at least one backrest on said longitudinal beam at a selected position; and said chamfer of said third rail piece includes an internally threaded hole to receive a third clamping screw having an end tip, said internally threaded hole of said chamfer of said third rail piece being oriented such that when said third clamping screw is screwed into said internally threaded hole of said chamfer of said third rail piece, said end tip of said third clamping screw enters said first longitudinal groove and presses against said longitudinal beam thereby fixing said third rail piece and said at least one tabletop on said longitudinal beam at a selected position.

12. The bench as claimed in claim 2, wherein each of said at least two feet has a front leg and a rear leg, said front leg being mounted onto said front surface of said longitudinal beam and said rear leg being mounted to said rear surface of said longitudinal beam.

13. The bench as claimed in claim 12, further comprising at least one armrest, each of said at least one armrests being placed onto said top surface of said longitudinal beam and releasably fixed directly to said longitudinal beam, and said front and said rear legs of each of said at least two feet being releasably connected to a corresponding one of said at least one armrests such that said front and said rear legs together with said at least one armrest, clasp said longitudinal beam.

14. The bench as claimed claim 13, wherein each of said front and said rear legs of said at least two feet has a base strut with a lower edge, said lower edge having an upwardly pointing hook contour said base strut of each of said front legs bears against said front surface of said longitudinal beam and said base strut of each of said rear legs bears against said rear surface of said longitudinal beam, said base strut of said front leg being positioned opposite said base strut of said rear leg, said base strut of each of said front and said rear legs of said at least two feet has an upper edge with a recess and said at least one armrest has a shoulder and a toe that fit into said recess.

15. The bench as claimed in claim 13, wherein each of said front and said rear legs of each of said at least two feet are releasably connected to said corresponding one of said at least one armrests by means of screws.

16. The bench as claimed in claim 15, wherein said at least one armrest has a plurality of holes therethrough, each of said holes receiving a corresponding one of said screws, each of said screws engaging a corresponding internally threaded hole in each of said front and said back legs of each of said at least two feet.

17. The bench as claimed in claim 12, wherein said front and said rear legs of each of said at least two feet are releasably connected, for countersupport, to a corresponding clamp-shaped bridge part which is placed onto said top surface of said longitudinal beam, such that said front and said rear legs together with said corresponding bridge part, clasp said longitudinal beam.

18. The bench as claimed in claim 17, wherein each of said front and said back legs of each of said at least two feet is connected to said corresponding bridge part by means of screws.

19. The bench as claimed in claim 18, wherein said bridge part has a plurality of holes therethrough, each of said holes receiving a corresponding one of said screws, each of said screws engaging a corresponding internally threaded hole in each of said front and said back legs of each of said at least two feet.

20. The bench as claimed in claim 17 wherein each of said front and said rear legs of said at least two feet has a base strut with a lower edge, said lower edge having an upwardly pointing hook contour said base strut of each of said front legs bears against said front surface of said longitudinal beam and said base strut of each of said rear legs bears against said rear surface of said longitudinal beam, said base strut of said front leg being positioned opposite said base strut of said rear leg, and said hook contour of said base strut of each of said front legs and said hook contour of said base strut of each of said rear legs engage said second longitudinal groove of said longitudinal beam.

21. The bench as claimed claim 20, wherein said base struts of each of said front and said rear legs of said at least two feet has an upper edge with a recess and said corresponding bridge part has a bridge shoulder and a bridge toe that fit into said recess.

22. A bench constructed in a modular manner, comprising:

an underframe having a longitudinal beam that is supported by at least two feet, each of said at least two feet being releasably fixed directly to said longitudinal beam;

at least one seat panel and at least one first retaining plate, each of said at least one seat panel being attached to a corresponding one of said at least one first retaining plate, and each of said at least one first retaining plate being releasably fixed directly to said longitudinal beam;

at least one backrest and at least one second retaining plate, each of said at least one backrest being attached to a corresponding one of said at least one second retaining plate, and each of said at least one second retaining plate being releasably fixed directly to said longitudinal beam; and at least one tabletop and at least one third retaining plate, wherein each of said at least one tabletop is attached to a corresponding one of said at least one third retaining plate, each of said at least one third retaining plate being releasably fixed directly to said longitudinal beam.

23. The bench as claimed in claim 22, wherein each of said at least one tabletop is releasably fastened on said corresponding one of said at least one third retaining plate.

24. A bench constructed in a modular manner, comprising:

an underframe having a longitudinal beam that is supported by at least two feet, each of said at least two feet being releasably fixed directly to said longitudinal beam;

at least one seat panel and at least one first retaining plate, each of said at least one seat panel being attached to a corresponding one of said at least one first retaining plate, and each of said at least one first retaining plate being releasably fixed directly to said longitudinal beam;

at least one backrest and at least one second retaining plate, each of said at least one backrest being attached to a corresponding one of said at least one second retaining plate, and each of said at least one second retaining plate being releasably fixed directly to said longitudinal beam; and at least one tabletop and at least one third retaining plate, each of said at least one tabletop being fixed on a corresponding one of said at least one third retaining plate by means of screws, and each of said at least one third retaining plate being releasably fixed directly to said longitudinal beam.

25. The bench as claimed in claim 24, wherein each of said at least one tabletop has a plurality of holes therethrough, each of said holes receiving a corresponding one of said screws, each of said screws engaging a corresponding one of a plurality of internally threaded holes in said corresponding one of said at least one third retaining plate.

26. A bench constructed in a modular manner, comprising:

an underframe having a longitudinal beam that is supported by at least two feet, each of said at least two feet being releasably fixed directly to said longitudinal beam;

at least one seat panel and at least one first retaining plate, each of said at least one seat panel being attached to a corresponding one of said at least one first retaining plate, and each of said at least one first retaining plate being releasably fixed directly to said longitudinal beam;

at least one backrest and at least one second retaining plate, each of said at least one backrest being attached to a corresponding one of said at least one second retaining plate, and each of said at least one second retaining plate being releasably fixed directly to said longitudinal beam; and at least one armrest, said at least one armrest being releasably fixed directly to said longitudinal beam.

27. The bench as claimed in claim 26, wherein said at least one armrest is placed onto said top surface of said longitudinal beam and is mounted thereon.

28. A bench constructed in a modular manner, comprising:

an underframe having a longitudinal beam that is supported by at least two feet, each of said at least two feet being releasably fixed directly to said longitudinal beam, said longitudinal beam having a top surface and front and rear surfaces;

at least one seat panel and at least one first retaining plate, each of said at least one seat panel being attached to a corresponding one of said at least one first retaining plate, and each of said at least one first retaining plate being releasably fixed directly to said longitudinal beam;

at least one backrest and at least one second retaining plate, each of said at least one backrest being attached to a corresponding one of said at least one second retaining plate, and each of said at least one second retaining plate being releasably fixed directly to said longitudinal beam; and at least one armrest, said at least one armrest being releasably fixed directly to said longitudinal beam, said at least one armrest being placed onto said top surface of said longitudinal beam and being mounted thereon, and said at least one armrest being releasably connected to a V-shaped bracket part which clasps said longitudinal beam from below and fits around said front surface and said rear surface of said longitudinal beam.

29. The bench as claimed in claim 28, wherein said at least one armrest is releasably connected to said V-shaped bracket part by means of screws.

30. The bench as claimed in claim 29, wherein said at least one armrest has a plurality of holes therethrough, each of said holes receiving a corresponding one of said screws, each of said screws engaging a corresponding one of a plurality of internally threaded holes in said bracket part.

* * * * *